US007292812B2

(12) United States Patent
Sato

(10) Patent No.: US 7,292,812 B2
(45) Date of Patent: Nov. 6, 2007

(54) IMAGE FORMING APPARATUS

(75) Inventor: Masumi Sato, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 175 days.

(21) Appl. No.: 10/921,933

(22) Filed: Aug. 20, 2004

(65) Prior Publication Data

US 2005/0042000 A1 Feb. 24, 2005

(30) Foreign Application Priority Data

Aug. 22, 2003 (JP) ..... 2003-298916
Jul. 7, 2004 (JP) ..... 2004-200964

(51) Int. Cl.
*G03G 15/16* (2006.01)
*G03G 15/01* (2006.01)

(52) U.S. Cl. ..... 399/297; 399/298; 399/299

(58) Field of Classification Search ..... 399/299, 399/346, 54, 223, 306, 53, 55
See application file for complete search history.

(56) References Cited

U.S. PATENT DOCUMENTS 5,144,337 A 9/1992 Imamura et al.
5,296,877 A 3/1994 Sato
5,400,123 A 3/1995 Sato et al.
5,659,843 A 8/1997 Takano et al.
5,719,684 A 2/1998 Ohkaji et al.
5,799,229 A 8/1998 Yokoyama et al.
5,878,317 A 3/1999 Masuda et al.
6,088,551 A 7/2000 Satoh et al.
6,104,419 A 8/2000 Sato
6,263,175 B1 7/2001 Sawada et al.
6,295,437 B1 * 9/2001 Hodoshima et al. ..... 399/346
6,334,039 B1 12/2001 Yoshinaga et al.
6,360,065 B1 3/2002 Ishibashi et al.
6,366,754 B1 4/2002 Sato et al.
6,393,241 B1 5/2002 Matsumoto et al.
6,470,161 B2 10/2002 Fujishiro et al.
6,501,913 B2 12/2002 Hattori et al.
6,505,022 B2 1/2003 Kosuge et al.
6,507,354 B1 1/2003 Sato
6,507,720 B2 1/2003 Kabumoto et al.
6,519,428 B1 2/2003 Ohtoshi et al.
6,546,219 B2 4/2003 Sato et al.
6,567,637 B2 5/2003 Yanagisawa et al.
6,567,643 B2 5/2003 Yasui et al.
6,591,077 B2 7/2003 Yanagisawa et al.

(Continued)

FOREIGN PATENT DOCUMENTS

JP 2002-139887 5/2002

(Continued)

*Primary Examiner*—David M. Gray
*Assistant Examiner*—David A Blackshire
(74) *Attorney, Agent, or Firm*—Oblon, Spivak, McClelland, Maier & Neustadt, P.C.

(57) ABSTRACT

An image forming apparatus includes at least two image bearing members, a transferring unit that makes a physical contact with both the image bearing members, and a lubricant applying unit that applies lubricant on the surface of the image bearing members. Images can be selectively formed on any one of the image bearing member. Although an image is being formed on one image bearing member, the transferring is made to come in physical contact with the other image bearing member.

13 Claims, 2 Drawing Sheets

U.S. PATENT DOCUMENTS 6,628,908 B2 9/2003 Matsumoto et al.
6,633,737 B1 * 10/2003 Tanaka et al. ..... 399/66
6,690,483 B1 * 2/2004 Ishida ..... 358/1.4
6,748,190 B2 6/2004 Yanagisawa et al.
6,760,562 B2 * 7/2004 Nishida et al. ..... 399/297
6,766,137 B2 7/2004 Yasui et al.
6,778,797 B2 8/2004 Sato et al.
7,046,938 B2 * 5/2006 Yamamoto et al. ..... 399/82
7,116,920 B2 * 10/2006 Yoshimoto ..... 399/13
2003/0108366 A1 * 6/2003 Yamada et al. ..... 399/298
2004/0165919 A1 * 8/2004 Nishida ..... 399/346
2005/0025520 A1 * 2/2005 Murakami et al. ..... 399/111

FOREIGN PATENT DOCUMENTS

JP 2000-293003 10/2003

* cited by examiner

IMAGE FORMING APPARATUS

CROSS-REFERENCE TO RELATED APPLICATIONS

The present document incorporates by reference the entire contents of Japanese priority documents, 2003-298916 filed in Japan on Aug. 22, 2003 and 2004-200964 filed in Japan on Jul. 7, 2004

BACKGROUND OF THE INVENTION

1) Field of the Invention

The present invention relates to an image forming apparatus, such as a copier, a printer, and a facsimile of electro photography-type or electrostatic-recording type, which can form images with two or more colors.

2) Description of the Related Art

In color image forming apparatuses, whether an image is to be formed in a monochrome mode or a color mode can be selected. Such an image forming apparatus includes an image formation unit corresponding to each color. Moreover, each image formation unit includes a photosensitive body.

When an image is to be formed in the color mode, for instance, the photosensitive body corresponding to black is not used. In a conventional image forming apparatus, when the image is to be formed in the color mode, for instance, the photosensitive body corresponding to black is physically separated from a transfer body to reduce friction between them and thus lengthen the life of the photosensitive body. However, there is a drawback in this technique, that the productivity lowers because there is a need to physically separate the photosensitive body from the transfer body.

Japanese Patent Application-Laid-Open No. 2000-293003 discloses an image forming apparatus that can surely, and at low power, perform switching between the color mode and the monochrome mode. Moreover, Japanese Patent Application-Laid-Open No. 2002-139887 discloses an image forming apparatus that decreases the running cost and the manufacturing cost by using a belt transfer device having a simpler structure.

SUMMARY OF THE INVENTION

An object of the present invention is to provide an image forming apparatus in which there is no need to physically separate the photosensitive body from the transfer body.

An image forming apparatus according to an aspect of the present invention includes a first image bearing member and a second image bearing member; a first developing unit and a second developing unit; a selection unit that selects any one developing unit to be used, from among the first developing unit to thereby form an image on the first image bearing member, and the second developing unit to thereby form an image on the second image bearing member; a transferring unit that makes physical contact with both the first image bearing member and the second image bearing member, and onto which images from both the first image bearing member and the second image bearing member are transferred; a first lubricant applying unit that applies a lubricant to the first image bearing member; and a second lubricant applying unit that applies a lubricant to the second image bearing member, wherein if the selection unit selects the first developing unit, the transferring unit is made to come in physical contact with the second developing unit and if the selection unit selects the second developing unit, the transferring unit is made to come in physical contact with the first developing unit.

An image forming apparatus according to another aspect of the present invention includes a first image bearing member and a second image bearing member, wherein an image can be selectively formed on any one of the first image bearing member and the second image bearing member, and a lubricant applying unit that applies a lubricant to the first image bearing member and the second image bearing member.

An image forming apparatus according to still another aspect of the present invention includes a first image bearing member and a second image bearing member, wherein an image can be selectively formed on any one of the first image bearing member and the second image bearing member, and a coefficient of friction of the first image bearing member and a coefficient of friction of the second image bearing member are both at the most 0.3.

The other objects, features, and advantages of the present invention are specifically set forth in or will become apparent from the following detailed description of the invention when read in conjunction with the accompanying drawings.

DETAILED DESCRIPTION

Exemplary embodiments of an image forming apparatus according to the present invention are explained below while referring to the accompanying drawings.

Figure 1:
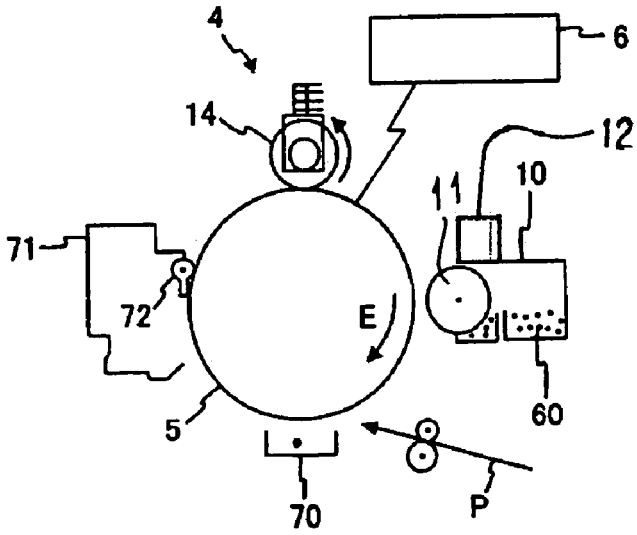
FIG. 1 is a side view of relevant portions of an image forming apparatus according to an embodiment of the present invention.

FIG. 1 is a side view of relevant portions of an image forming apparatus according to an embodiment of the present invention. The image forming apparatus includes a photosensitive drum 5 and an electric charger 4 that charges the photosensitive drum 5. The photosensitive drum 5 rotates in a direction represented by arrows E and C. The photosensitive drum 5 is an image bearing member that carries an image. The electric charger 4 includes an electrification roller 14 as a charger.

The image forming apparatus includes a writing unit 6 that forms an electrostatic latent image on the surface of the photosensitive drum 5 by exposing the surface of the photosensitive drum 5. The image forming apparatus further includes a developing device 10 and a transfer device 70. The developing device 10 forms a visible image (that is, a toner image) by developing the electrostatic latent image with a developer 60 on the surface of photosensitive drum 5.

The developing device 10 includes a roller 11 that stirs as well as transports a toner 60 to the surface of photosensitive drum 5. A clutch mechanism 12 drive controls this roller 11.

The transfer device 70 transfers the visible image that is present on the surface of the photosensitive drum 5 to a transfer body P such as a paper. After the transfer, traces of toner sometimes remain on the surface of the photosensitive drum 5. Therefore, the image forming apparatus is provided with a cleaning device 71 that cleans and removes such toner.

The cleaning device 71 includes a cleaning blade 72. The tip of the cleaning blade 72 is configured in such a manner that it touches the surface of photosensitive drum 5 at an optimal angle and an optimal contact pressure so that the toner can be easily and completely removed from the surface of the photosensitive drum 5.

Figure 2:
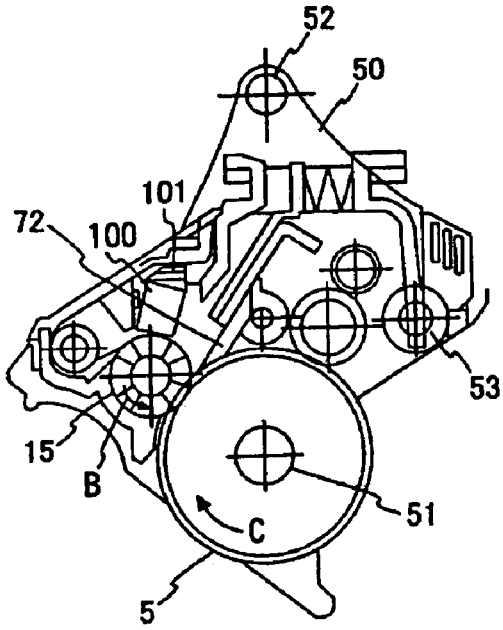
FIG. 2 is a side view of a photosensitive unit of the image forming apparatus.

FIG. 2 is a side view of a photosensitive unit of the image forming apparatus. The photosensitive unit can be detachably fit into a main body 1 of the image forming apparatus shown in FIG. 3. The photosensitive unit includes a main fixing part 51 that is used as a reference when fitting the photosensitive unit in the main body 1. The photosensitive unit also has a bracket 50 that has parts 52 and 53. The part 53 is used for positioning in the front side and the part 52 is used for positioning in the interior side. As a result, the photosensitive unit can surely and firmly be attached to a predetermined position inside the main unit 1.

A lubricant spreading mechanism is arranged in the upstream of the cleaning blade 72. This lubricant spreading mechanism includes a brush roller 15, a lubricant 100, and a spring 101 that presses the lubricant 100 to the brush roller 15. The brush roller 15 is made to rotate at a speed that is 1.1 times of the line velocity of the photosensitive drum 5 in the direction indicated by an arrow B (see FIG. 2). Thus, the lubricant 100 is applied on the surface of the photosensitive drum 5. Because of the presence of the lubricant, the cleaning blade 72 scratches the toner from the photosensitive drum 5 without damaging it. The lubricant 100 is solid zinc stearate in the form of a rod of size 8 mm×8 mm and weight 20 grams.

As another embodiment, instead of providing the lubricant spreading mechanism, a photosensitive drum having a low coefficient of friction can be used to obtain the same effects. The photosensitive drum having the low coefficient of friction can be manufactured by forming a coat of fluorine on the surface of an ordinary photosensitive drum.

A problem in typical image forming apparatuses is that, because in the monochrome mode the development units corresponding to other colors rotate unnecessarily, the quality of the toners of the other colors deteriorates. To solve this problem, in the present embodiment, an arrangement is provided so that those development units that are not used for image formation do not rotate. Consequently, deterioration of the quality of the toners is prevented.

Another problem in the typical image forming apparatuses is that, static electricity acts on the photosensitive drum 5 and damages the photosensitive drum 5. To solve this problem, in the present embodiment, an arrangement is provided that can adjust a charging bias and a developing bias, which are generally applied to the photosensitive drum 5, in such a manner that the static electricity does not act on the photosensitive drum 5. If the bias is lowered or completely turned off, static electricity does not act on the photosensitive drum 5. Therefore, damage of the photosensitive drum 5 is prevented.

Still another problem in the typical image forming apparatuses is that, the toner in the image formation unit upstream mixes with the toner in the image formation unit downstream. This causes degradation in the image quality. To solve this problem, in the present embodiment, an arrangement is provided that can adjust a transfer bias. The transfer bias is lowered or completely turned off.

Lubricant 100 is cut-down from the rod by the brush roller 15 little by little. Because the brush roller 15 is in physical contact with the photosensitive drum 5, the cut-down lubricant 100 spreads on the surface of the photosensitive drum 5. If the life of the photosensitive unit is assumed to be equivalent to printing of A4 sized, portrait-oriented, 100K papers, then the amount of the lubricant 100 required for smooth operation is 15 grams.

The lubricant 100 is applied to the photosensitive drum 5 to such an extent that the coefficient of friction (I) of the photosensitive drum 5 is 0.2 or less. The coefficient of friction is measured using the oiler belt method, in which the photosensitive drum 5 without an image is rotated until a saturated value is obtained. Using T6200 paper for the measurements, the inventor confirmed that the photosensitive drum 5 showed no signs of damage when the coefficient of friction of the photosensitive drum 5 was 0.3 or less.

Figure 3:
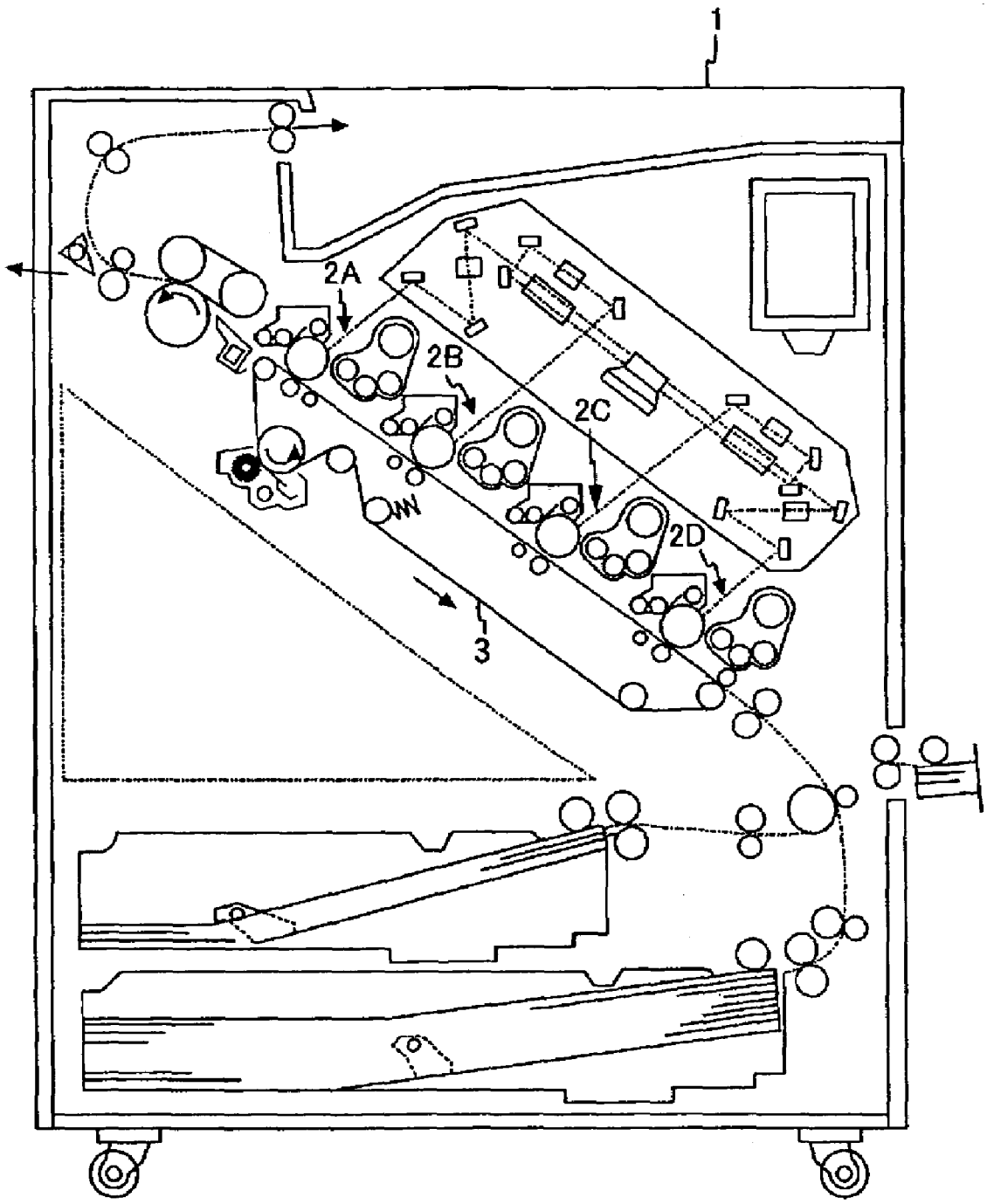
FIG. 3 is a side view of the entire image forming apparatus.

FIG. 3 is a side view of the entire image forming apparatus. This image forming apparatus is a color image forming apparatus of the tandem type. That is, in the main body 1 of the image forming apparatus, two or more image forming units 2A to 2D are lined-up along a transfer belt 3. The image forming units 2A to 2D correspond to yellow (Y), black (BK), cyan (C), and magenta (M), respectively.

Each image forming unit 2A to 2D has the configuration of the photosensitive unit shown in FIG. 2. In other words, each image forming unit 2A to 2D has a photosensitive drum, a lubricant spreading unit, a cleaning blade, and a developing device. Each developing device can be driven independently.

One or more of the image forming units 2A to 2D can be selectively operated. For instance, in the monochrome mode, only the image unit 2A is operated. On the other hand, in the color mode, only the image forming units 2B to 2D are operated.

However, in the monochrome mode, although only the image unit 2A is operated, even the photosensitive drums of the other image forming units 2B to 2D are rotated and are not physically separated from the transfer belt 3. Similarly, in the color mode, although only the image forming units 2B to 2D are operated, even the photosensitive drum of the image forming units 2A is rotated and is not physically separated from the transfer belt 3.

Because the lubricant is spread on the surface of the photosensitive drum, wear-out of the photosensitive drum, the cleaning blade, and the transfer belt 3 can be suppressed. Moreover, efficiency improves, because it is not necessary to physically separate the photosensitive drum and the transfer body.

Although it is explained above that the development units of the image forming units 2B to 2D are operated in the case of the monochrome mode, it is possible to stop operation of these development units to reduce power consumption. Moreover, the charging bias of the image forming units 2B to 2D may be lowered or completely turned off so that static electricity does not act on the photosensitive drums of the image forming units 2B to 2D. Furthermore, the developing bias of image forming units 2B to 2D may be lowered or may be completely turned off. Opposite is the case for the color mode.

Still another problem in the typical image forming apparatuses is that, the image formed by the image forming unit 2A gets reverse-transferred, although in traces, onto the images formed by the image forming units 2B to 2D. To overcome this problem, in the present embodiment, an arrangement is provided that can adjust a transfer bias. The transfer bias can be lowered or completely turned off. Moreover, the transfer bias in those image forming units that are not operating can be lowered or completely turned off to reduce power consumption.

Same effects can be obtained if the transfer belt is replaced by intermediate transfer belt.

Thus, according to the present invention, wear-out of the photosensitive drum, the cleaning blade, and the transfer belt can be suppressed. Moreover, efficiency can be improved because there is now no need to physically separate the photosensitive drum and the transfer body.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a first image bearing member and a second image bearing member;

a first developing unit connected to a first clutch drive and a second developing unit connected to a second clutch drive;

a selection unit that selects any one developing unit to be used, from among the first developing unit to thereby form an image on the first image bearing member, and the second developing unit to thereby form an image on the second image bearing member;

a transferring unit that makes physical contact with both the first image bearing member and the second image bearing member;

a first lubricant applying unit that applies a lubricant to the first image bearing member; and a second lubricant applying unit that applies a lubricant to the second image bearing member, wherein if the selection unit selects the first developing unit, the transferring unit remains in physical contact with the second image bearing unit and if the selection unit selects the second developing unit, the transferring unit remains in physical contact with the first image bearing unit, and wherein the first clutch drive is configured to drive the first developing unit when the selection unit selects the first developing unit and not when the selection unit selects the second developing unit, and the second clutch drive is configured to drive the second developing unit when the selection unit selects the second developing unit and not when the selection unit selects the first developing unit.

2. The image forming apparatus of claim 1, wherein the first lubricant applying unit that applies a lubricant to the first image bearing member is configured to apply the lubricant via a first brush that, at a point of contact with the first image bearing member, moves in a same direction as the first image bearing member, and the second lubricant applying unit that applies a lubricant to the second image bearing member is configured to apply the lubricant via a second brush that, at a point of contact with the second image bearing member, moves in a same direction as the second image bearing member.

3. An image forming apparatus comprising:

a first image bearing member and a second image bearing member;

a first developing unit and a second developing unit;

a selection unit that selects any one developing unit to be used, from among the first developing unit to thereby form an image on the first image bearing member, and the second developing unit to thereby form an image on the second image bearing member;

a transferring unit that makes physical contact with both the first image bearing member and the second image bearing member;

a first lubricant applying unit that applies a lubricant to the first image bearing member; and a second lubricant applying unit that applies a lubricant to the second image bearing member, wherein if the selection unit selects the first developing unit, the transferring unit remains in physical contact with the second image bearing unit and if the selection unit selects the second developing unit, the transferring unit remains in physical contact with the first image bearing unit, wherein the first developing unit is configured to apply a first developing bias between toner and the first image bearing member; and the second developing unit is configured to apply a second developing bias between toner and the second image bearing member, wherein if the selection unit selects the first developing unit, the second developing unit applies any one of a developing bias that is lower than the first developing bias and zero to the second image bearing member, and if the selection unit selects the second developing unit, the first developing unit applies any one of a developing bias that is lower than the second developing bias and zero to the first image bearing member.

4. The image forming apparatus according to claim 3, further comprising:

a first removal unit that removes a toner that remains on the first image bearing member after an image on the first image bearing member is transferred to the transferring unit; and a second removal unit that removes a toner that remains on the second image bearing member after an image on the second image bearing member is transferred to the transferring unit.

5. The image forming apparatus according to claim 3, wherein if the selection unit selects the first developing unit, the second developing unit is not driven, and if the selection unit selects the second developing unit, the first developing unit is not driven.

6. The image forming apparatus according to claim 3, further comprising:

a first charging bias applying unit configured to apply a first charging bias to the first image bearing member; and a second charging bias applying unit configured to apply a second charging bias to the second image bearing member, wherein if the selection unit selects the first developing unit, the second charging bias applying unit applies any one of a charging bias that is lower than the first charging bias and zero to the second image bearing member, and if the selection unit selects the second developing unit, the first charging bias applying unit applies any one of a charging bias that is lower than the second charging bias and zero to the first image bearing member.

7. The image forming apparatus according to claim 3, wherein the transferring unit is configured also to transfer a transfer body.

8. The image forming apparatus according to claim 3, wherein a coefficient of friction of the first image bearing member and a coefficient of friction of the second image bearing member after applying the lubricant are at the most 0.3.

9. The image forming apparatus according to claim 3, wherein the lubricant is solid zinc stearate in the form of a rod of size 8 mm×8 mm and weight 20 grams.

10. The image forming apparatus according to claim 3, wherein the first image bearing member corresponds to black and the second image bearing member corresponds to at least one color selected from yellow, cyan, and magenta.

11. The image forming apparatus of claim 3, wherein the lubricant applying unit that applies a lubricant to the first image bearing member and the second image bearing member is configured to apply the lubricant via first and second brushes that, at a point of contact with the first and second image bearing members, move in a same direction as the first and second image bearing members, respectively.

12. An image forming apparatus comprising:

a first image bearing member and a second image bearing member;

a first developing unit and a second developing unit;

a selection unit that selects any one developing unit to be used, from among the first developing unit to thereby form an image on the first image bearing member, and the second developing unit to thereby form an image on the second image bearing member;

a transferring unit that makes physical contact with both the first image bearing member and the second image bearing member;

a first lubricant applying unit that applies a lubricant to the first image bearing member; and a second lubricant applying unit that applies a lubricant to the second image bearing member, wherein if the selection unit selects the first developing unit, the transferring unit remains in physical contact with the second image bearing unit and if the selection unit selects the second developing unit, the transferring unit remains in physical contact with the first image bearing unit, further comprising a transfer device configured to apply a transfer bias between the transfer unit and image bearing members, wherein if the selection unit selects the first developing unit, the transfer device applies any one of a transfer bias that is lower than a transfer bias applied between the transfer unit and the first image bearing member and zero to the second image bearing member, and if the selection unit selects the second developing unit, the transfer device applies any one of a transfer bias that is lower than a transfer bias applied between the transfer unit and the second image bearing member and zero to the first image bearing member.

13. An image forming apparatus comprising:

a first image bearing member and a second image bearing member;

a first developing unit and a second developing unit;

a selection unit that selects any one developing unit to be used, from among the first developing unit to thereby form an image on the first image bearing member, and the second developing unit to thereby form an image on the second image bearing member;

a transferring unit that makes physical contact with both the first image bearing member and the second image bearing member;

a first lubricant applying unit that applies a lubricant to the first image bearing member; and a second lubricant applying unit that applies a lubricant to the second image bearing member, wherein if the selection unit selects the first developing unit, the transferring unit remains in physical contact with the second image bearing unit and if the selection unit selects the second developing unit, the transferring unit remains in physical contact with the first image bearing unit, wherein a speed of an edge of a brush moves at 1.1 times a speed of the image bearing member at a point of contact with the brush.

* * * * *